US011091943B2

(12) United States Patent
Ferreira et al.

(10) Patent No.: US 11,091,943 B2
(45) Date of Patent: Aug. 17, 2021

(54) ARTICULATING WIRE CHASE FOR USE WITH AN ARTICULATING HINGE FOR AN APPLIANCE DOOR

(71) Applicant: WHIRLPOOL CORPORATION, Benton Harbor, MI (US)

(72) Inventors: Luiz Afrânio Alves Ferreira, Joinville (BR); Daniel Felipe Soares, Sao Paulo (BR); Gustavo Spezzia, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 52 days.

(21) Appl. No.: 16/236,389

(22) Filed: Dec. 29, 2018

(65) Prior Publication Data

US 2020/0208450 A1 Jul. 2, 2020

(51) Int. Cl.

| | |
|---|---|
| ***F25D 23/02*** | (2006.01) |
| ***E05D 11/00*** | (2006.01) |
| ***E05D 3/16*** | (2006.01) |
| ***E05D 3/06*** | (2006.01) |

(52) U.S. Cl.

CPC ..... *E05D 11/0081* (2013.01); *E05D 3/06* (2013.01); *E05D 11/0054* (2013.01); *F25D 23/028* (2013.01); *E05D 2011/0072* (2013.01); *E05Y 2900/31* (2013.01); *F25D 2323/024* (2013.01)

(58) Field of Classification Search

CPC ..... E05D 11/081; E05D 11/0084; E05D 11/0054; E05D 3/06; E05D 3/14; E05D 3/16; E05D 2011/0072; E05D 11/0081; H02G 11/00; E05Y 2900/31; F25D 2323/024; F25D 23/028; G06F 1/1683

See application file for complete search history.

(56) References Cited

U.S. PATENT DOCUMENTS

| | | | |
|---|---|---|---|
| 3,883,201 | A | 5/1975 | Luciano |
| 8,033,623 | B2 | 10/2011 | Lee |
| 8,245,352 | B2 | 8/2012 | Park |
| 8,366,220 | B2 | 2/2013 | Oberhauser et al. |
| 9,115,928 | B2 | 8/2015 | Akalan et al. |
| 9,790,721 | B2 | 10/2017 | Ueyama |
| 2006/0064846 | A1 | 3/2006 | Espindola et al. |

(Continued)

FOREIGN PATENT DOCUMENTS

| | | |
|---|---|---|
| DE | 202007008106 | 10/2008 |
| KR | 20090074936 | 7/2009 |

*Primary Examiner* — Emily M Morgan

(74) *Attorney, Agent, or Firm* — Price Heneveld LLP

(57) ABSTRACT

A hinge assembly for a refrigerating appliance includes a door engaging member that is configured to attach to a door panel through an operational path of the door engaging member. A cabinet engaging member is configured to attach to a structural cabinet. An articulating mechanism extending between the door engaging member and the cabinet engaging member. The articulating mechanism partially defines the operational path of the door engaging member. An articulating wire chase that is coupled to the cabinet engaging member and slidably coupled to the articulating mechanism at a guide slot. The articulating mechanism is operable between a collapsed position and an extended position. Operation of the articulating mechanism operates the articulating wire chase between a serpentine position and an elongated position.

13 Claims, 11 Drawing Sheets

(56) References Cited

U.S. PATENT DOCUMENTS

| | | | | |
|---|---|---|---|---|
| 2008/0276422 | A1* | 11/2008 | Beckmann | E05D 11/0054 16/258 |
| 2010/0176701 | A1* | 7/2010 | Oberhauser | E05D 11/0081 312/405 |
| 2014/0210328 | A1* | 7/2014 | Akalan | E05D 7/00 312/326 |
| 2016/0123055 | A1* | 5/2016 | Ueyama | H04B 7/24 312/405 |
| 2016/0201975 | A1* | 7/2016 | Bazzucchi | E05D 11/0081 312/405 |
| 2017/0188721 | A1 | 7/2017 | Park et al. | |
| 2018/0187956 | A1* | 7/2018 | Kim | E05D 11/0081 |
| 2018/0223582 | A1 | 8/2018 | Shin et al. | |
| 2019/0383081 | A1* | 12/2019 | Thielmann | E05D 11/0054 |

* cited by examiner

ARTICULATING WIRE CHASE FOR USE WITH AN ARTICULATING HINGE FOR AN APPLIANCE DOOR

FIELD OF THE DEVICE

The device is in the field of appliance hinges, and more specifically, an articulating wire chase that is integrally operable with an articulating hinge extending between an appliance cabinet and an articulating appliance door.

SUMMARY

In at least one aspect, a hinge assembly for a refrigerating appliance includes a door engaging member that is configured to attach to a door panel through an operational path of the door engaging member. A cabinet engaging member is configured to attach to a structural cabinet. An articulating mechanism extending between the door engaging member and the cabinet engaging member. The articulating mechanism partially defines the operational path of the door engaging member. An articulating wire chase that is coupled to the cabinet engaging member and slidably coupled to the articulating mechanism at a guide slot. The articulating mechanism is operable between a collapsed position and an extended position. Operation of the articulating mechanism operates the articulating wire chase between a serpentine position and an elongated position.

In at least another aspect, an appliance includes a structural cabinet, an operable door panel, an articulating hinge assembly that operationally engages the door panel to the structural cabinet to define an operational path of the door panel that includes an open position and a closed position and an articulating wire chase that extends from the structural cabinet to the operable door panel. The articulating hinge assembly includes a four-part linkage and the articulating wire chase includes a three-part linkage that incorporates a portion of the four-part linkage. The articulating hinge assembly and the articulating wire chase cooperatively operate between collapsed and extended positions.

In at least another aspect, a hinge assembly for a refrigerating appliance includes a door engaging member attached to a door panel. A cabinet engaging member is attached to a structural cabinet. An articulating mechanism extends between the door engaging member and the cabinet engaging member. The articulating mechanism partially defines an operational path of the door engaging member between collapsed and extended positions. An articulating wire chase is rotationally coupled to the cabinet engaging member and slidably coupled to the articulating mechanism at a guide slot. Operation of the articulating mechanism between the collapsed position and the extended position corresponds to operation of the articulating wire chase between a serpentine position and an elongated position. A flexible conduit extends from the structural cabinet to the door panel and is retained within the articulating wire chase in each of the serpentine and elongated positions, wherein the flexible conduit is secured by a plurality of hold-down features of the articulating wire chase.

These and other features, advantages, and objects of the present device will be further understood and appreciated by those skilled in the art upon studying the following specification, claims, and appended drawings.

DETAILED DESCRIPTION OF EMBODIMENTS

Figure 1:
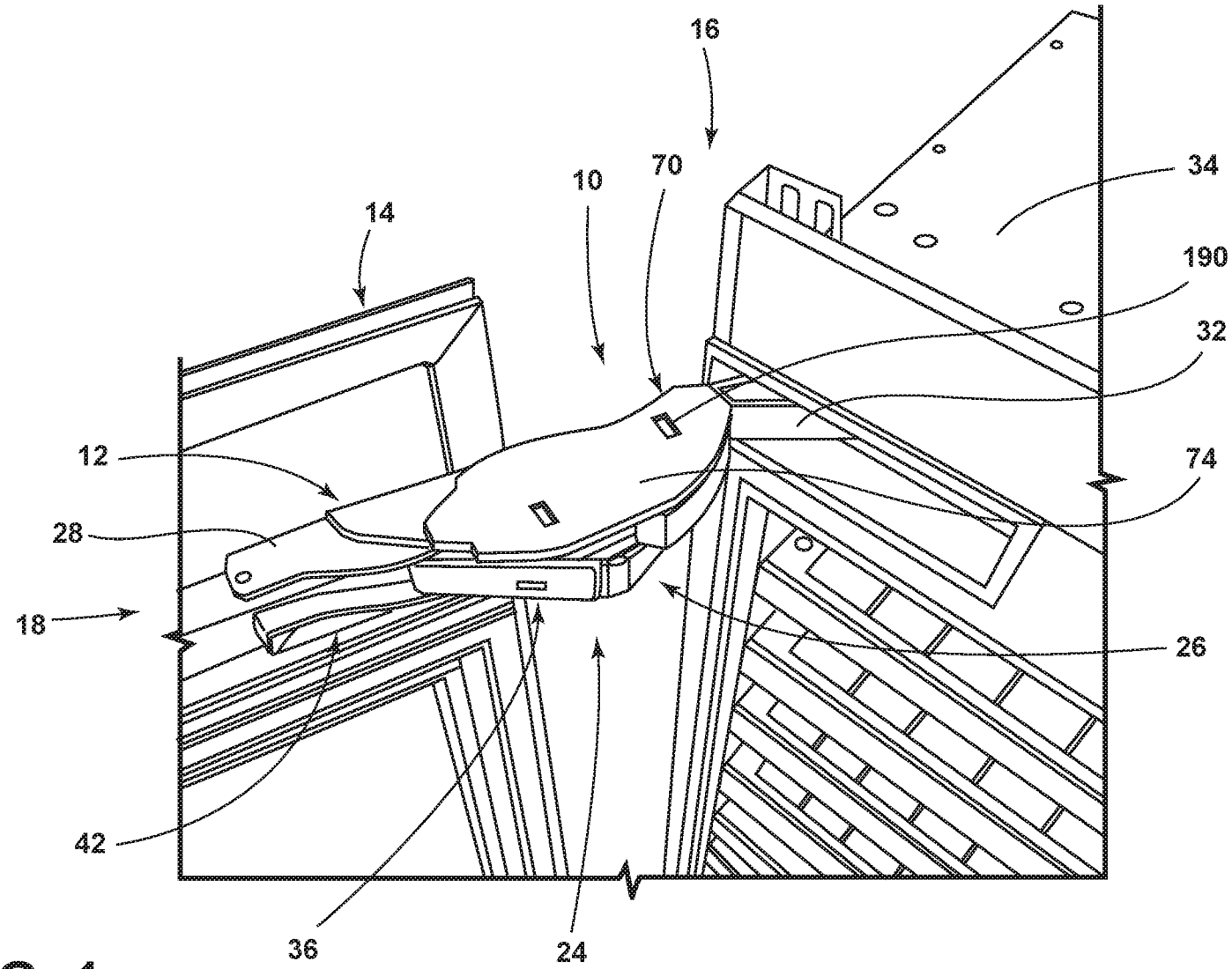
FIG. 1 is a top perspective view of an aspect of an appliance that incorporates an articulating hinge having an aspect of the articulating wire chase.
Figure 2:
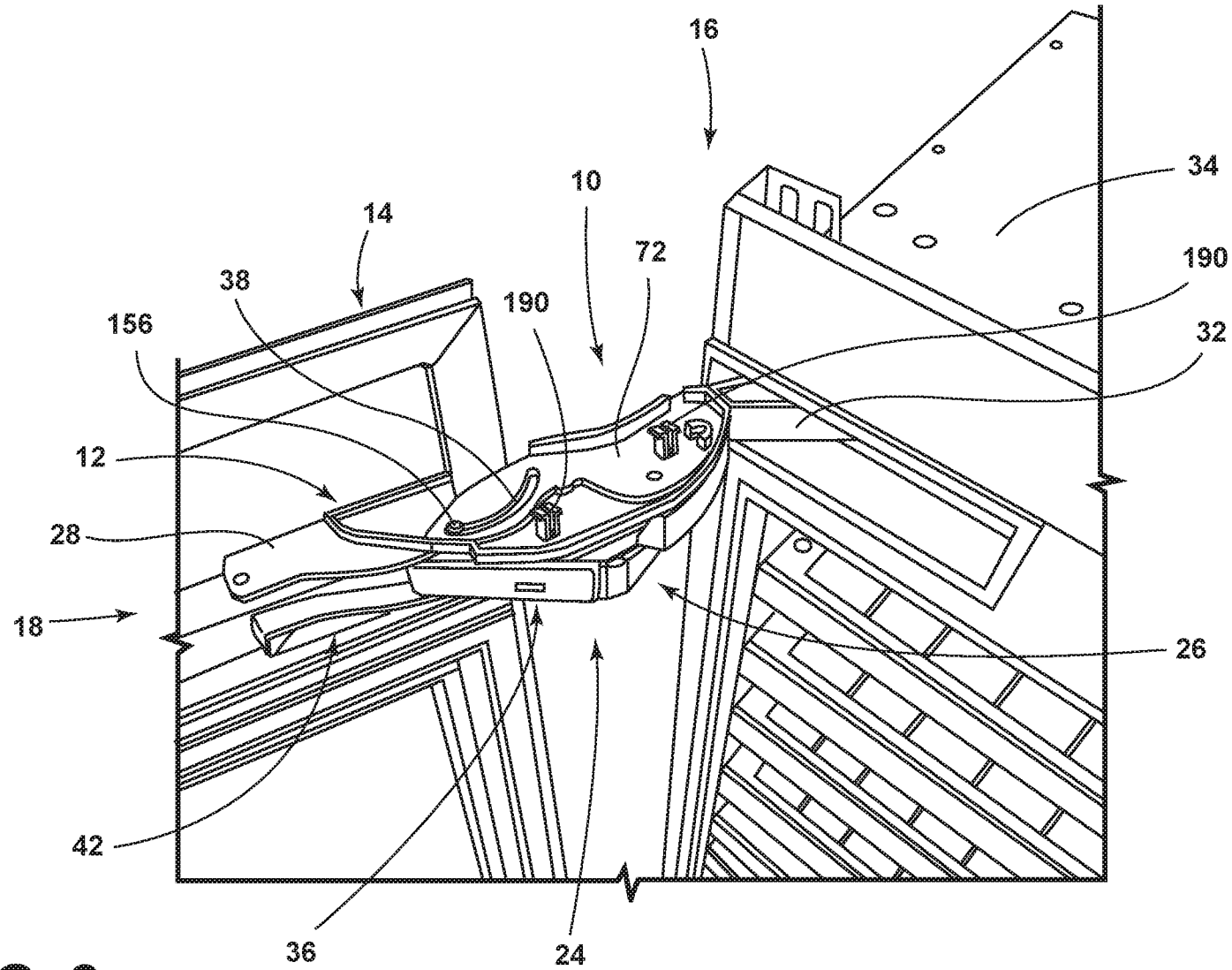
FIG. 2 is a top perspective view of the articulating hinge of FIG. 1 with an enclosure member removed.
Figure 3:
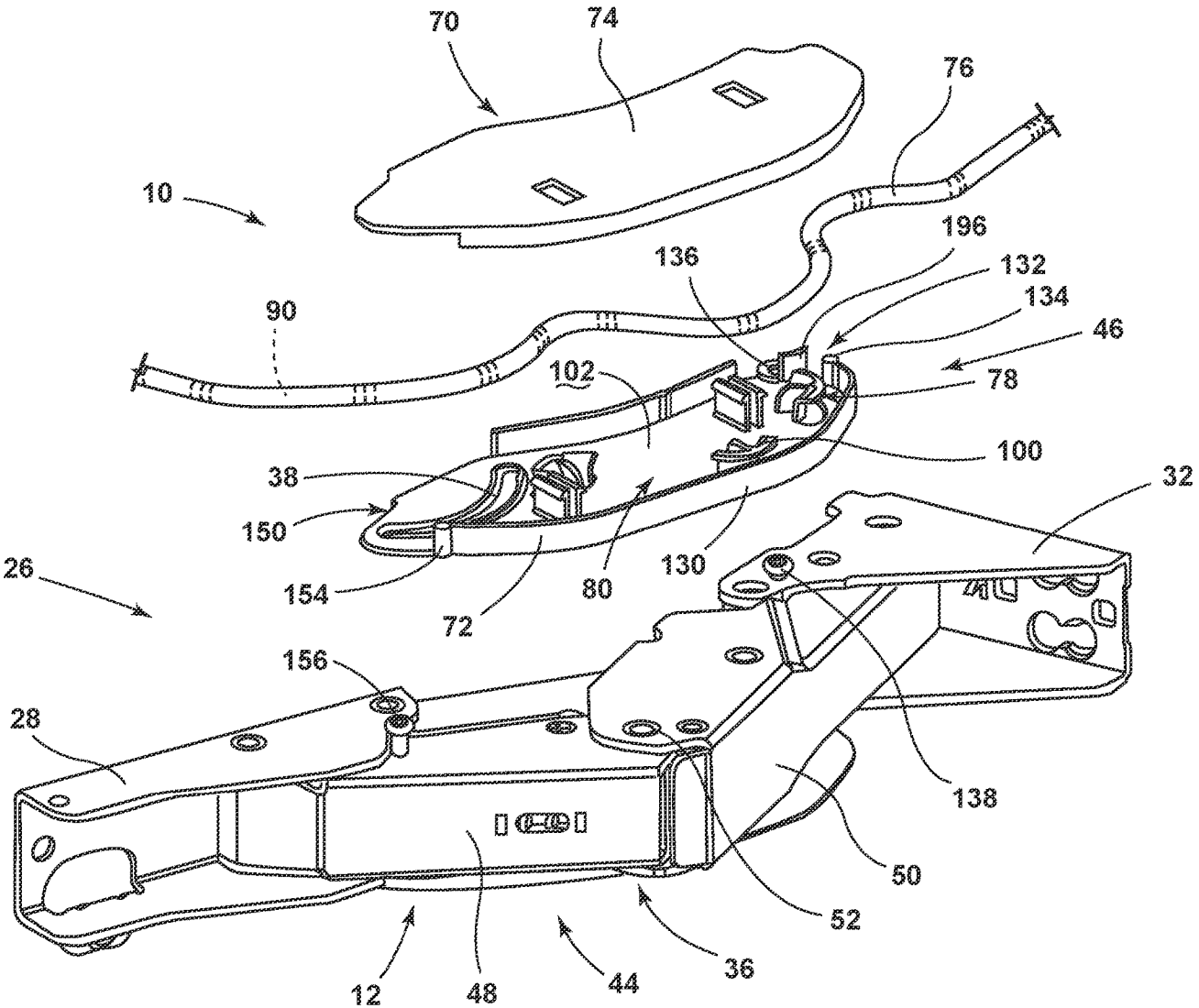
FIG. 3 is an exploded perspective view of an aspect of the articulating wire chase and the articulating hinge.
Figure 4:
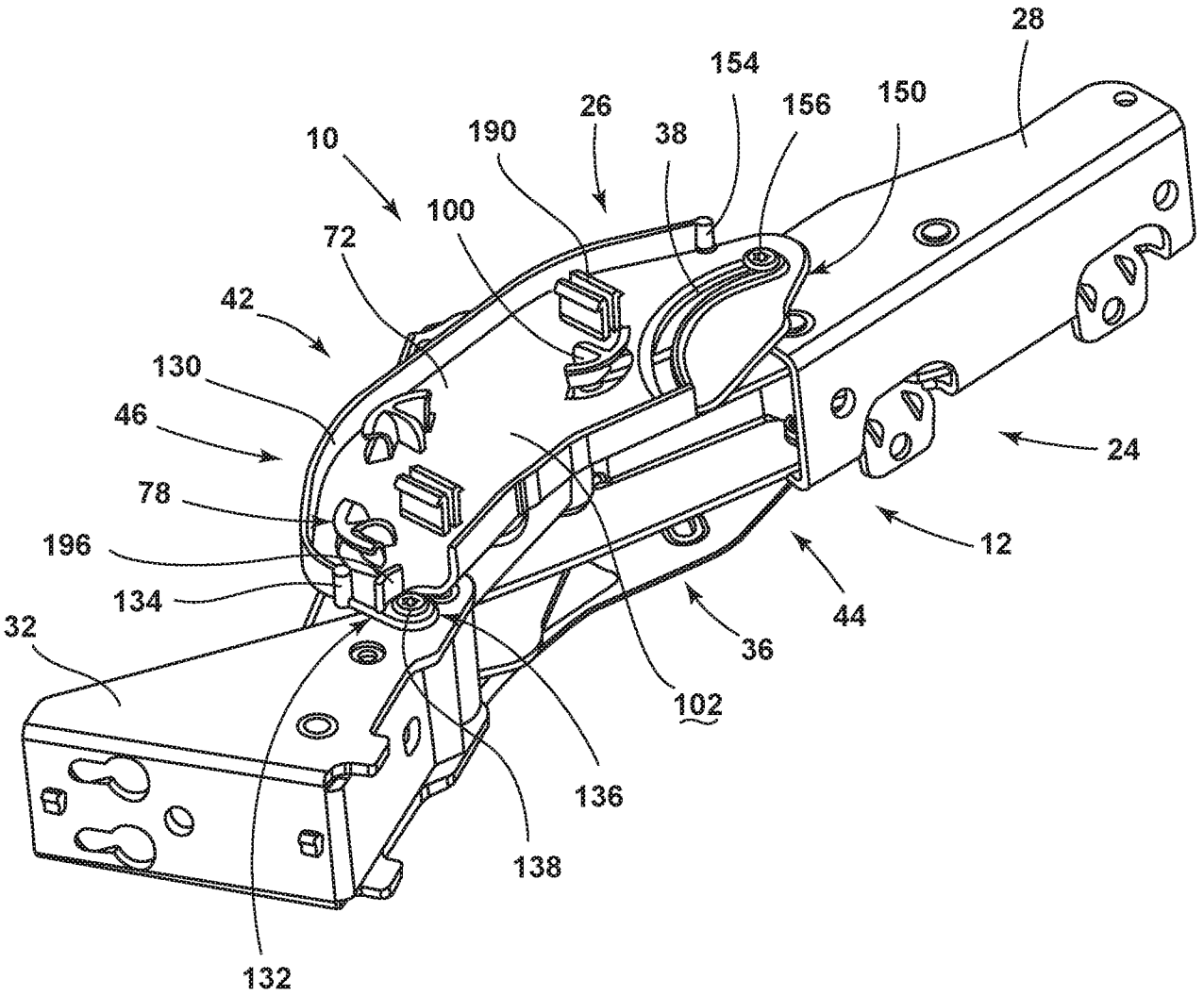
FIG. 4 is a top perspective view of the articulating hinge and a base member of the articulating wire chase, shown in an extended position.
Figure 5:
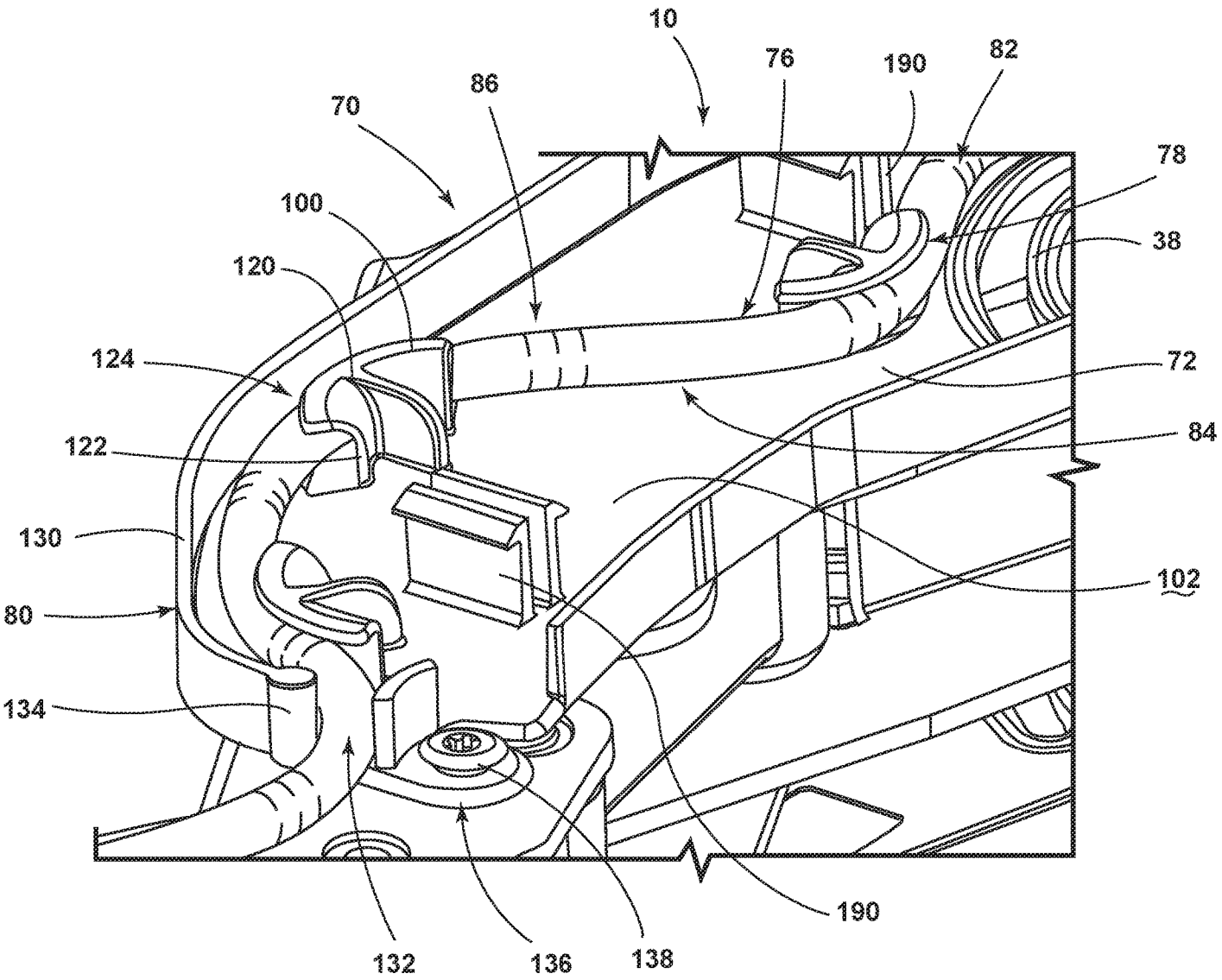
FIG. 5 is a top perspective view of the articulating hinge of FIG. 4 and showing an aspect of the flexible conduit positioned within the articulating wire chase and shown in the elongated position.
Figure 6:
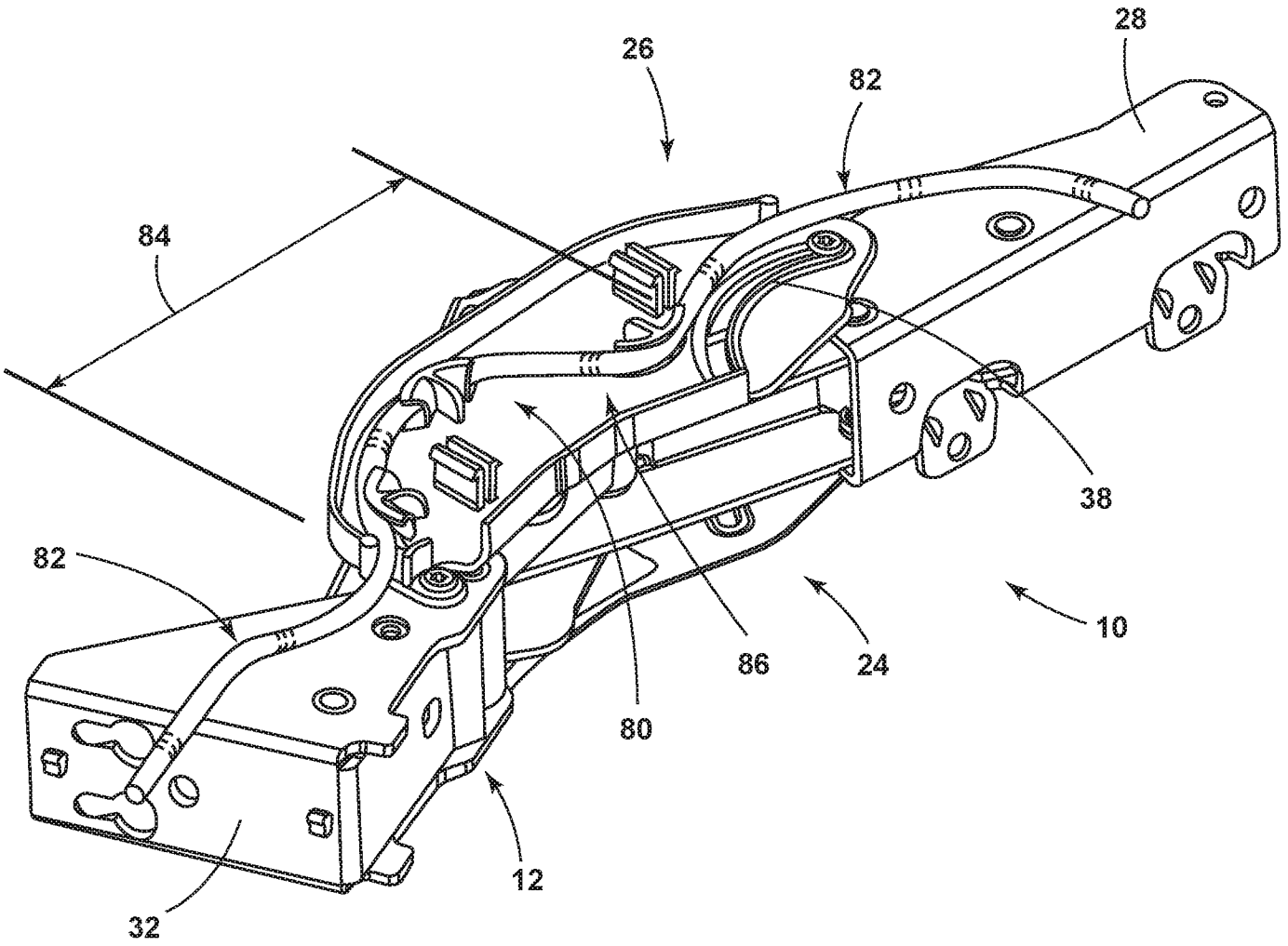
FIG. 6 is an enlarged perspective view of the articulating hinge of FIG. 5 taken at area VI-VI.
Figure 7:
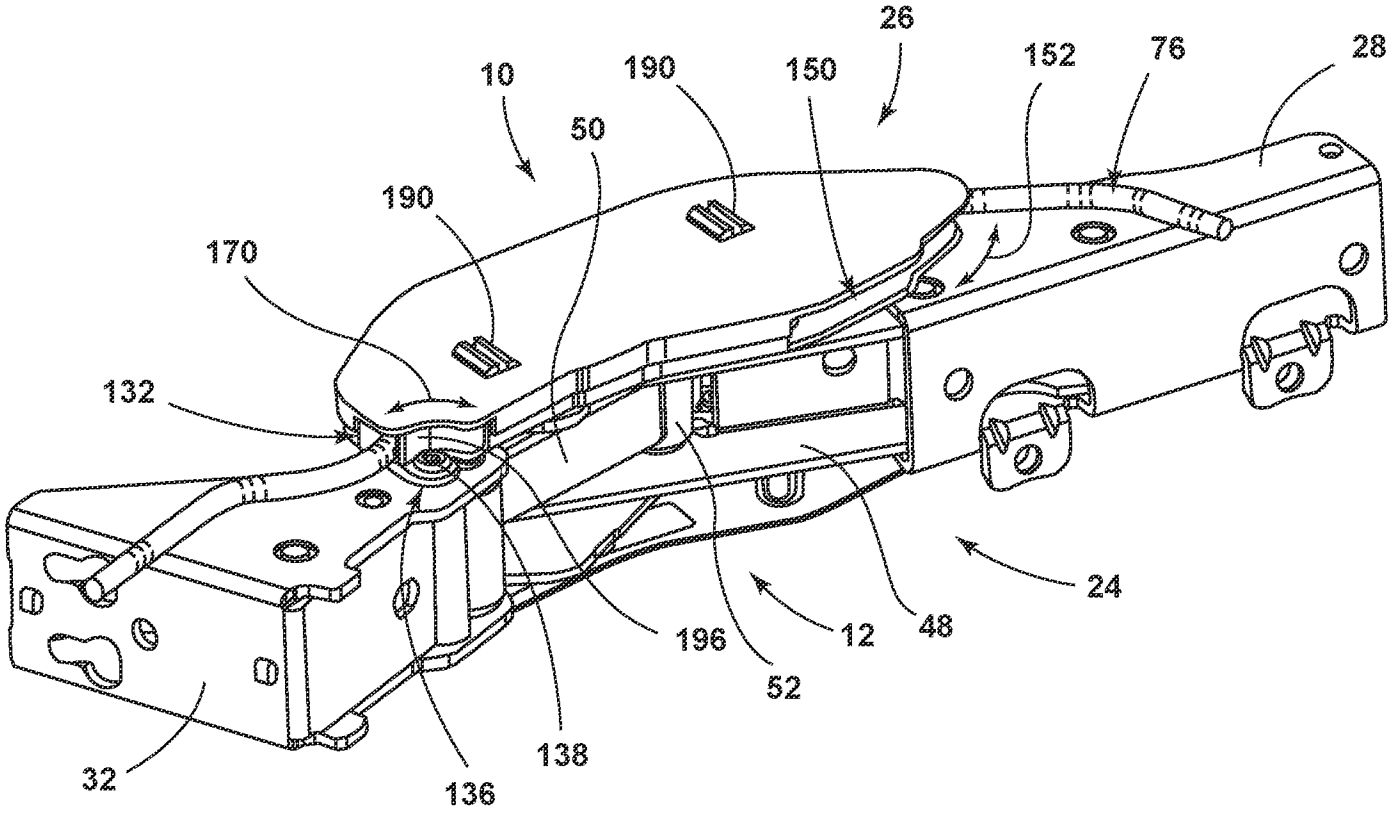
FIG. 7 is a top perspective view of the articulating hinge of FIG. 5 and showing the enclosure member coupled with the base member.
Figure 8:
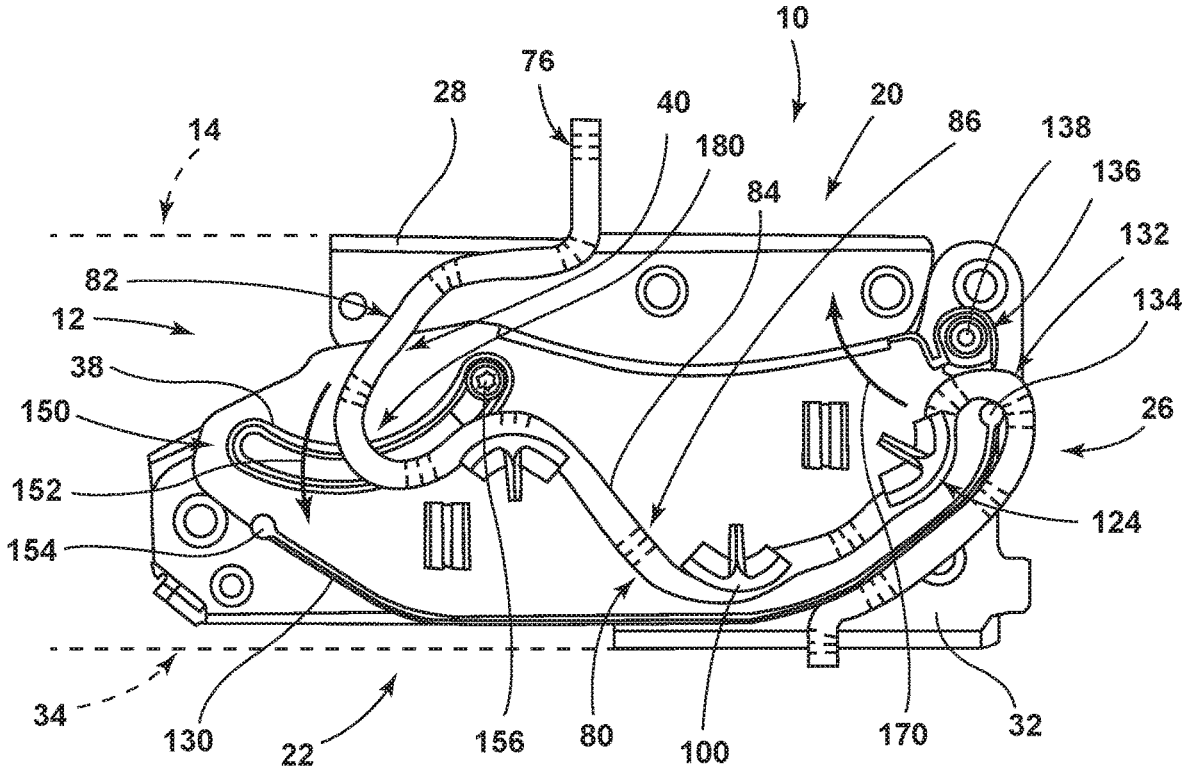
FIG. 8 is a top plan view of the articulating hinge in the collapsed position and the articulating wire chase shown in a serpentine position, with the enclosure member removed.
Figure 9:
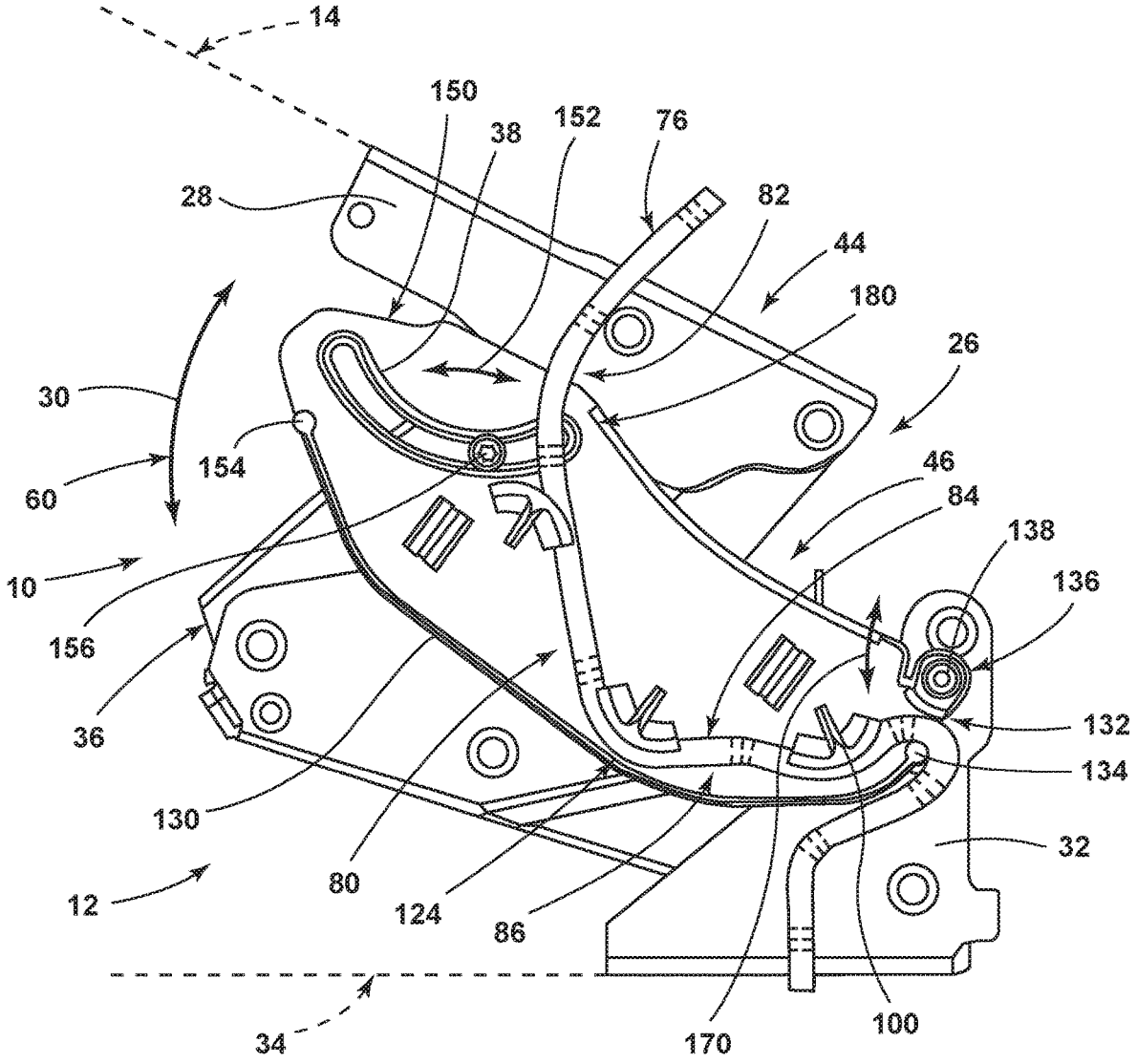
FIG. 9 is a top plan view of the articulating hinge of FIG. 8 and showing the articulating hinge and the articulating wire chase moving toward the elongated position.
Figure 10:
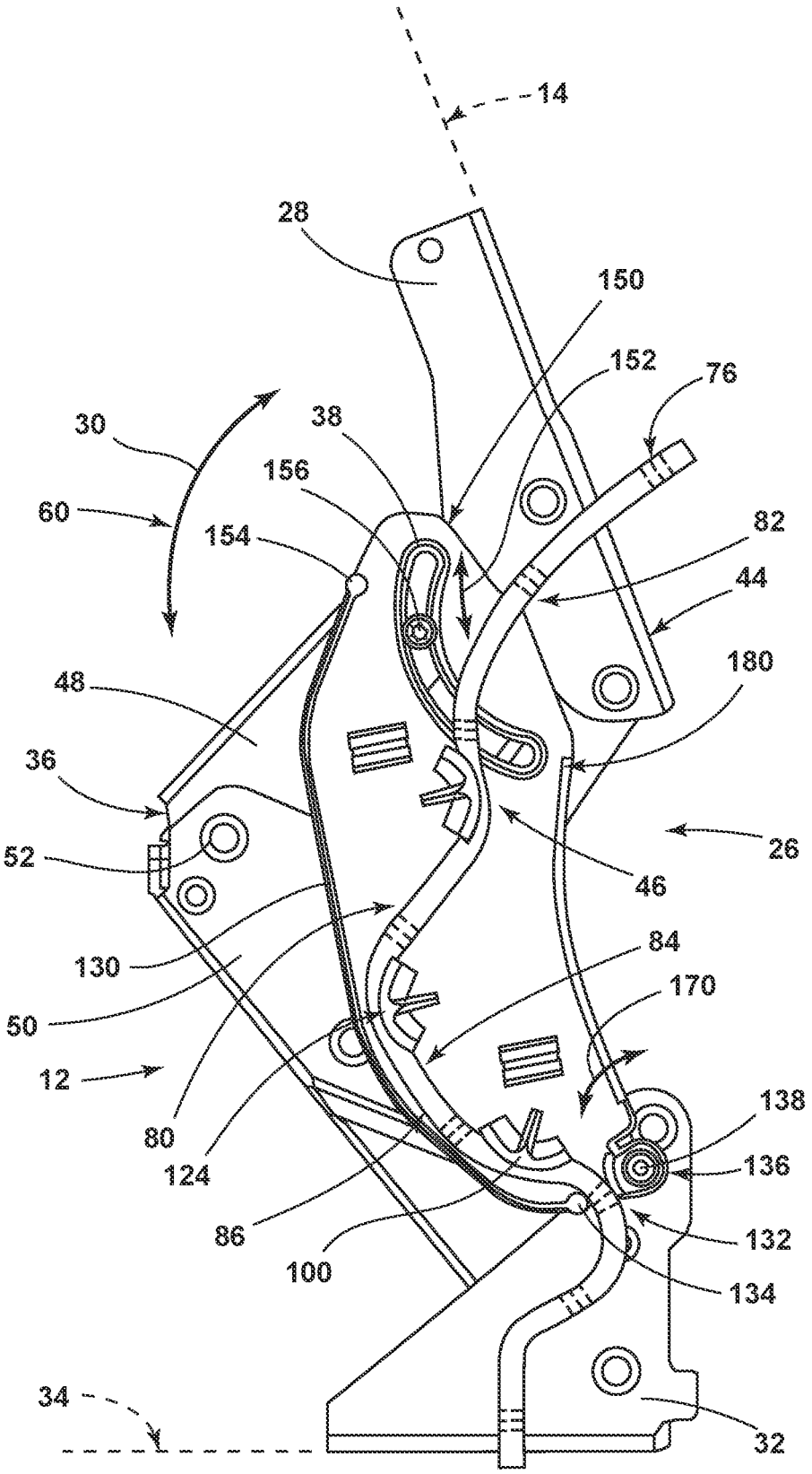
FIG. 10 is a top plan view of the articulating hinge of FIG. 9 and showing the articulating hinge moving toward the extended position.
Figure 11:
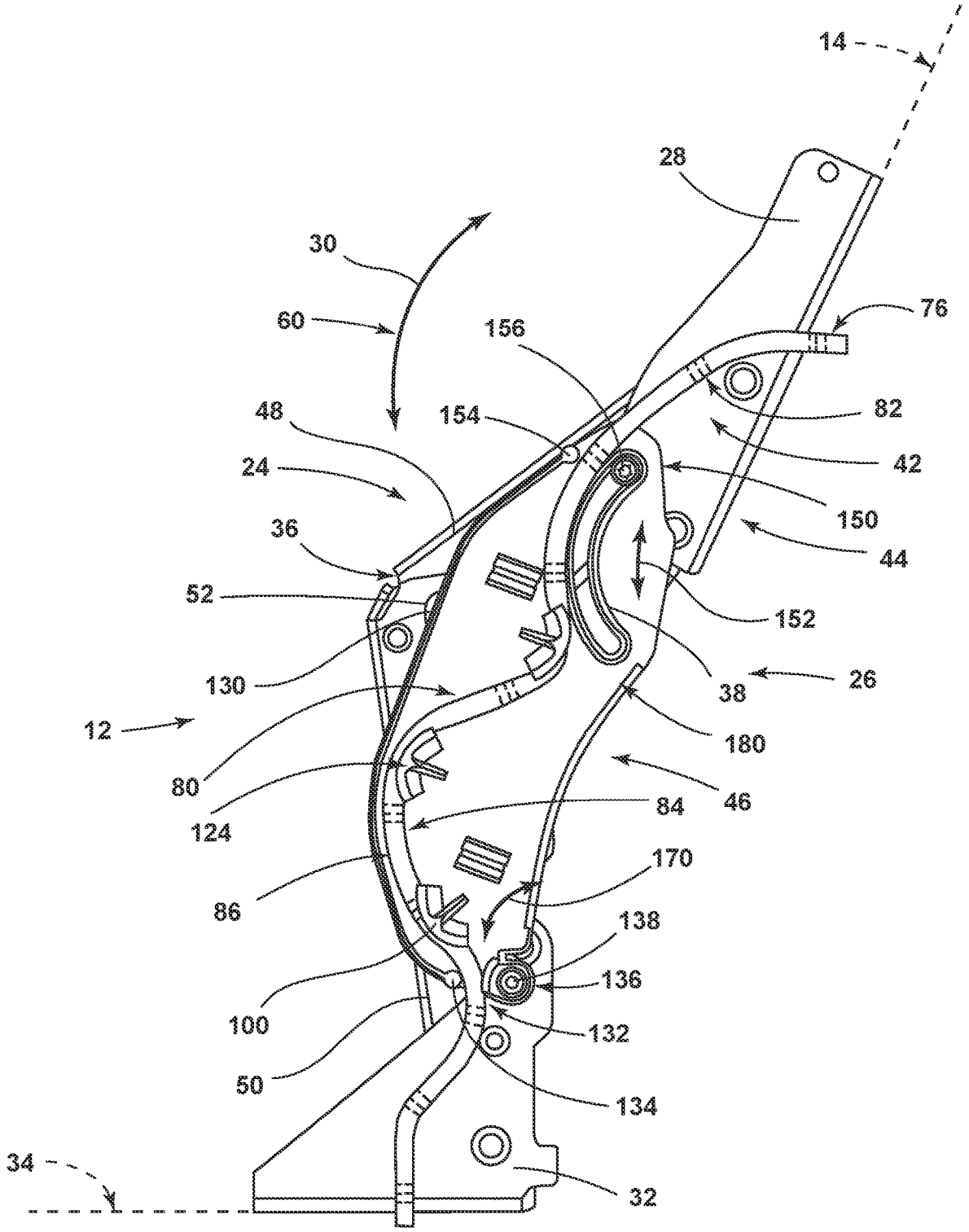
FIG. 11 is a top plan view of the articulating hinge in the extended position and the articulating wire chase in the elongated position.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-11, reference numeral 10 generally refers to an articulating wire chase that is incorporated within an articulating hinge 12 for operating a door panel 14 for an appliance 16 between open and closed positions 18, 20. Typically, the closed position 20 of the door panel 14 corresponds to a collapsed position 22 of the articulating hinge 12. Additionally, the open position 18 of the door panel 14 typically corresponds to an extended position 24 of the articulating hinge 12. According to various aspects of the device, a hinge assembly 26 for an appliance 16, typically a refrigerating appliance, includes an articulating hinge 12 positioned at top and bottom portions of the door panel 14. The articulating hinge 12 can include a door engaging member 28 or bracket that is configured to attach to the door panel 14. During operation of the door panel 14, the door engaging member 28 operates through an operational path 30 for the articulating hinge 12. A cabinet engaging member 32 or bracket is configured to attach to the structural cabinet 34. An articulating mechanism 36 extends between the door engaging member 28 and the cabinet engaging member 32. The articulating mechanism 36 includes a door-side member 48 and a cabinet-side member 50 that meet at an articulating pivot 52. The articulating mechanism 36 partially defines the operational path 30 of the door engaging member 28. An articulating wire chase 10 is rotationally coupled to the cabinet engaging member 32 and is slidably coupled to a portion of the articulating mechanism 36 at a guide slot 38 of the articulating wire chase 10. The articulating mechanism 36 is operable between a collapsed position 22 and an extended position 24. Operation of the articulating mechanism 36 contemporaneously operates the articulating wire chase 10 between a serpentine position 40 that corresponds to the collapsed position 22 and an elongated position 42 that corresponds to the extended position 24 of the articulating hinge 12. Through this configuration, the door engaging member 28, the cabinet engaging member 32 and the articulating mechanism 36 (made up of the door-side and cabinet-side members 48, 50, define a four-part linkage 44 that operates the door panel 14 between the open and closed positions 18, 20. The articulating wire chase 10 couples with the cabinet engaging member 32 and part of the articulating mechanism 36, typically, the door-side member 50, to define a three-part linkage 46 that cooperatively operates with the four-part linkage 44 between the collapsed and extended positions 22, 24.

Referring again to FIGS. 1-11, the articulating hinge 12 of the hinge assembly 26 serves to operate the door panel 14 between the closed position 20 and an open position 18 through the operational path 30 of the door engaging member 28. The articulating hinge 12 having the articulating wire chase 10 can be located proximate a top portion of the door panel 14 or proximate a bottom portion of the door panel 14, or both. Through the operation of the articulating hinge 12, the door panel 14 operates to the open position 18 in a simultaneous rotational and outward translating motion 60 that rotates the door panel 14 away from the structural cabinet 34 and also translates a position of the door panel 14 away from the structural cabinet 34. The use of the articulating hinge 12 provides for placement of the appliance 16 in a relatively confined space and in a generally flush configuration with surrounding millwork and cabinetry. The use of the articulating hinge 12 also provides the user with a gliding-type feel and aesthetic for the door panel 14 as it moves between the open and closed positions 18, 20. The articulating hinge 12 can also provide for a precise open position 18 of the door panel 14 where the articulating hinge 12 stops the outward translating motion 60 of the door panel 14 at the extended position 24 of the articulating hinge 12.

In using the articulating hinge 12 in connection with the door panel 14, various services including electricity and water can be delivered from the structural cabinet 34 and into the door panel 14. These services are delivered via the articulating hinge 12 and into various components contained within the door panel 14. These components can include, but are not limited to, electrical controls, water dispensers, ice dispensers, user interface mechanisms, connectivity devices, combinations thereof, and other similar devices that may require electrical communication and/or fluid communication between the door panel 14 and the structural cabinet 34.

Referring again to FIGS. 3-11, the articulating wire chase 10 can include a housing 70 that includes a base member 72 and an enclosure member 74. The base member 72 is typically coupled with portions of the articulating hinge 12 and includes the guide slot 38. Through this connection, the articulating wire chase 10 forms a simultaneous rotating and translating motion 60 that cooperates with the translating motion 60 of the articulating hinge 12. A flexible conduit 76 extends from the structural cabinet 34 and to the door panel 14 and is retained within the articulating wire chase 10 in each of the serpentine and elongated positions 40, 42. The flexible conduit 76 is typically secured within the articulating wire chase 10 by a plurality of hold-down features 78 that are defined within the articulating wire chase 10. The plurality of hold-down features 78 that secure the flexible conduit 76 can at least partially define a securing portion 80 of the articulating wire chase 10. An adjusting portion 82 of the flexible conduit 76 is typically positioned outside of the securing portion 80 and is slidably operable with respect to the articulating mechanism 36 and the articulating wire chase 10. A stable portion 84 of the flexible conduit 76 is located within the securing portion 80 of the articulating wire chase 10. The stable portion 84 of the flexible conduit 76 is configured to maintain a consistent position 86 or a substantially consistent position 86 with respect to the articulating wire chase 10 as the articulating wire chase 10 operates between the serpentine position 40 and the elongated position 42. Maintaining portions of the flexible conduit 76 in the consistent position 86 serves to define a substantially repeatable motion of the flexible conduit 76 as it moves with respect to the articulating wire chase 10 between the serpentine position 40 and the elongated position 42.

As discussed above, the serpentine position 40 and the elongated position 42 correspond to the collapsed position 22 and the extended position 24, respectively, of the articulating hinge 12. Using the substantially consistent position 86 of the flexible conduit 76, and the substantially repeatable motion, pinching, crimping and other undesirable folding of the flexible conduit 76 can be prevented, that might otherwise cause damage to the wiring, tubing, and other service conduits 90 contained within the flexible conduit 76.

Referring again to FIGS. 3-11, the housing 70 for the articulating wire chase 10 can include the hold-down features 78 that may extend from the base member 72 of the housing 70 or from the enclosure member 74 of the housing 70. Typically, the hold-down features 78 include arcuate retainers 100 that substantially encircle portions of the flexible conduit 76. The flexible conduit 76 can rest within the arcuate shape of the arcuate retainers 100. Additionally, in certain aspects of the device, the flexible conduit 76 can snap into, or under, portions of the arcuate retainers 100 to be held in place between an upper surface 102 of the base member 72 and the arcuate retainers 100.

As exemplified in FIGS. 3-6, the arcuate retainers 100 include a first curved portions 120 that extends upward from the upper surface 102 of the base member 72 and curves generally perpendicular to form at least a portion of the securing portion 80 of the articulating wire chase 10. Additionally, the arcuate retainers 100 can also include a second curved portion 122 that curves along the shape of the securing portion 80 to form predetermined bending locations 124 for the flexible conduit 76. These predetermined bending locations 124 are typically used to define the stable portion 84 of the flexible conduit 76 located within the securing portion 80 for the articulating wire chase 10. Accordingly, as the articulating wire chase 10 and the articulating hinge 12 are moved from the collapsed position 22 to the extended position 24, the flexible conduit 76 can be substantially retained within the arcuate retainers 100 to define the stable portion 84 that remains in the substantially consistent position 86 through the movement of the articulating hinge 12 and the articulating wire chase 10. In this manner, the positioning of the stable portion 84 of the flexible conduit 76 in the serpentine position 40 is substantially similar to that of the stable portion 84 for the flexible conduit 76 in the elongated position 42. As discussed above, this configuration of the arcuate retainers 100 for the articulating wire chase 10 are configured to prevent unwanted crimping, folding, or other damage to the flexible conduit 76 or the service conduits 90 contained therein. The arcuate retainers 100 also provide for a limited amount of controlled bending at the second curved portion 122 that defines the bending locations 124.

In addition to the arcuate retainers 100, the base member 72 of the housing 70 can include an outer wall 130 that at least partially defines a cabinet side aperture 132 of the housing 70. This cabinet side aperture 132 can at least partially define the securing portion 80 of the housing 70. Within the cabinet side aperture 132 of the housing 70, the flexible conduit 76 is maintained within the substantially consistent position 86 and can form part of the stable portion 84 of the flexible conduit 76 during operation of the articulating wire chase 10 and the articulating hinge 12. The outer wall 130 for the base member 72 can include a cabinet side bumper 134 that forms a portion of the cabinet side aperture 132. The cabinet side aperture 132 can also be defined by a pivot 136 that rotationally engages a post 138 of the articulating hinge 12. During operation of the articulating wire chase 10 and the articulating hinge 12, the housing 70 of the articulating wire chase 10 rotationally operates about the pivot 136. The post 138 extending upward from the articulating hinge 12 extends through the pivot 136 and can define a portion of the cabinet side aperture 132 that partially defines the securing portion 80 of the wire chase 10. Accordingly, the cabinet side aperture 132 of the housing 70 is defined by the cabinet side bumper 134 and the pivot 136 that rotationally engages the post 138 of the articulating hinge 12.

Referring again to FIGS. 3-11, the housing 70 also defines a door side aperture 150 that defines a sliding path 152 through which the flexible conduit 76 operates to define serpentine and elongated positions 40, 42. A portion of the flexible conduit 76 that slides within the door side aperture 150 is part of the adjusting portion 82 of the flexible conduit 76. The outer wall 130 of the base member 72 also includes a door side bumper 154. The door side bumper 154 defines an outer extent of the sliding path 152 for the adjusting portion 82 of the flexible conduit 76. In certain embodiments, the door side bumper 154 also defines the elongated position 42 of the flexible conduit 76, wherein the flexible conduit 76 is positioned against or near the door side bumper 154 in the elongated position 42. The door side bumper 154 of the housing 70 and a sliding member 156 that extends upward from the door-side member 50 of the articulating hinge 12 may cooperate to maintain the flexible conduit 76 in a predetermined position that is indicative of the elongated position 42 of the flexible conduit 76. The sliding member 156 slidably operates through the guide slot 38 defined within the base member 72 of the housing 70 for the articulating wire chase 10.

In various aspects of the device, operation of the sliding member 156 through the guide slot 38 from the collapsed position 22 to the extended position 24 may bias the flexible conduit 76 toward a predetermined state of the elongated position 42 for the flexible conduit 76. As the sliding member 156 moves through the guide slot 38, the sliding member 156 may bias the flexible conduit 76 toward the door side bumper 154.

In certain aspects of the device, the sliding member 156 that operates through the guide slot 38 may have a substantially low profile such that as the sliding member 156 moves through the guide slot 38, the sliding member 156 may pass under portions of the flexible conduit 76 as the articulating hinge 12 and the articulating wire chase 10 operate between the collapsed position 22 and the extended position 24.

Referring again to FIGS. 1-11, various aspects of the appliance 16 can include the structural cabinet 34 and the operable door panel 14 that is coupled to the structural cabinet 34 to define open and closed positions 18, 20. The articulating hinge assembly 26 that includes the articulating hinge 12 operationally engages the door panel 14 to the structural cabinet 34 to define an operational path 30 of the door panel 14 that includes the open and closed positions 18, 20. The articulating wire chase 10 extends from the structural cabinet 34 to the operable door. The articulating hinge 12 includes a four-part linkage 44 and the articulating wire chase 10 includes a three-part linkage 46 that incorporates a portion of the four-part linkage 44. The articulating hinge assembly 26 and the articulating wire chase 10 cooperatively operate between the collapsed and extended positions 22, 24. During operation of the articulating hinge 12 and the articulating wire chase 10, the flexible conduit 76 includes a stable portion 84 that maintains the consistent or substantially consistent position 86 with respect to the articulating wire chase 10 and the securing portion 80 of the wire chase 10. Additionally, an adjusting portion 82 of the flexible conduit 76 slidingly operates with respect to the articulating hinge 12 and the articulating wire chase 10 in a substantially repeatable fashion as the door panel 14 operates between the open and closed positions 18, 20.

Referring again to FIGS. 1-11, the articulating wire chase 10 includes a guide slot 38 that slidably engages the sliding member 156 of the articulating hinge 12. The guide slot 38 is configured to be a slot defined within the base member 72 of the housing 70 that forms the articulating wire chase 10. Movement of the sliding member 156 through the guide slot 38 serves to guide a rotational operation 170 of the base member 72 with respect to the pivot 136 that is positioned at the opposite end of the housing 70. The rotational operation 170 of the base member 72, in conjunction with the translating motion 60 of the door engaging member 28 define the translating motion 60 of the door engaging member 28 define the translating motion 60 of the articulating wire chase 10.

In certain aspects of the device, the translating motion 60 of the articulating hinge 12 cooperates with the guide slot 38 of the articulating wire chase 10 to promote a rotational movement of the housing 70 about the pivot 136. Through this configuration, the stable portion 84 of the flexible conduit 76 that is positioned at the door side aperture 150 at least partially rotates about the pivot 136 as the articulating wire chase 10 operates between the serpentine and extended positions 40, 24. In such an embodiment, the cabinet side aperture 132 remains relatively close to the structural cabinet 34 to prevent tugging of the flexible conduit 76 away from the structural cabinet 34. Conversely, the serpentine position 40 of the flexible conduit 76 within the articulating wire chase 10 in the collapsed position 22 provides for an accumulated slack 180 of the flexible conduit 76 within the articulating wire chase 10. As the articulating wire chase 10 operates from the serpentine position 40 toward the elongated position 42, the accumulated slack 180 of the flexible conduit 76 within the articulating wire chase 10 is substantially straightened to define the elongated position 42 of the flexible conduit 76 that moves through the stable portion 84 of the flexible conduit 76 and the adjusting portion 82 of the flexible conduit 76.

Referring again to FIGS. 3-11, the base member 72 and the enclosure member 74 that form the housing 70 can be coupled together via various clipping mechanisms 190 that extend between the base member 72 and the enclosure member 74. The clipping mechanism 190 of the base member 72 is positioned so as not to disturb the movement of the flexible conduit 76 between the serpentine position 40 and the elongated position 42.

Referring again to FIGS. 6-11, the pivot 136 that engages the post 138 of the articulating hinge 12 can include a shield member 196 that extends at least partially around the post 138. In this manner, the shield member 196 serves to at least partially define the cabinet side aperture 132 of the housing 70 and also maintains a separation between the flexible conduit 76 and the pivot 136 and the post 138 during operation of the articulating hinge 12 between the collapsed and extended positions 22, 24.

Referring again to FIGS. 3-11, the base member 72 of the articulating wire chase 10 can include at least one arcuate retainer 100 for maintaining the stable portion 84 of the flexible conduit 76 within the substantially consistent position 86. In various aspects, the base member 72 can include three separate arcuate retainers 100 that are positioned in a generally serpentine or sinusoidal configuration within the housing 70. During operation of the articulating hinge 12 between the collapsed and extended positions 22, 24, the stable portion 84 of the flexible conduit 76 maintains the substantially consistent position 86 within the housing 70 as the articulating wire chase 10 moves between the serpentine position 40 and the elongated position 42.

During this movement of the flexible conduit 76, the adjusting portion 82 of the flexible conduit 76 slidably operates along the housing 70 and also along portions of the articulating hinge 12 as the door moves between the closed position 20 and the open position 18.

According to various aspects of the device, the articulating hinge 12 having the integrated articulating wire chase 10 can be used in various appliances 16. Such appliances 16 can include, but are not limited to, refrigerators, freezers, laundry appliances, dishwashers, small appliances, and other similar appliances that require use of an operable panel that may operate between open and closed positions 18, 20.

In various aspects of the device, the housing 70 for the articulating wire chase 10 can be made of various materials. Such materials can include, but are not limited to, plastic, various polymers, composite materials, metals, combinations thereof, and other similar materials. It is also contemplated that the base member 72 and the enclosure member 74 for the housing 70 can be made of different materials where various finishes are desired near the articulating hinge 12.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A hinge assembly and a refrigerating appliance, the hinge assembly comprising:

a door engaging member that is attached to a door panel;

a cabinet engaging member that is attached to a structural cabinet and having a post;

an articulating mechanism that extends between the door engaging member and the cabinet engaging member and partially defines an operational path of the door engaging member between a collapsed position and an extended position, the articulating mechanism having a pin;

an articulating wire chase operable with the articulating mechanism between the collapsed and extended positions, the articulating wire chase including a housing having a base member and an enclosure member, the base member rotationally coupled to the post of the cabinet engaging member, and the base member having a guide slot that slidably engages the pin of the articulating mechanism, and the articulating wire chase including sidewalls extending between the base member and the enclosure member, the articulating wire chase including a securing portion within the sidewalls, the base member and the enclosure member; and a flexible conduit extending between the door panel and the structural cabinet, the flexible conduit having a secure portion extending through the securing portion of the articulating wire chase, a non-secured portion extending through the articulating wire chase between the door panel and the securing portion, the secured portion of the flexible conduit within the securing portion is secured against the base member;

wherein the secured portion of the flexible conduit is fixedly secured as the articulating mechanism operates between the collapsed and extended positions, and wherein the non-secured portion of the flexible conduit is slidably operable relative to the articulating wire chase and the articulating mechanism.

2. The hinge assembly of claim 1, wherein the securing portion of the articulating wire chase includes hold down features that extend from the base member.

3. The hinge assembly of claim 2, wherein the sidewalls extending between the base member and the enclosure member of the articulating wire chase define a door side aperture and a cabinet side aperture, wherein the flexible conduit is slidably operable within the door side aperture to define a serpentine position of the flexible conduit in the collapsed position and an elongated position of the flexible conduit in the extended position.

4. The hinge assembly of claim 2, wherein the hold down features include arcuate retainers that substantially encircle portions of the flexible conduit.

5. The hinge assembly of claim 3, wherein one of the hold down features of the securing portion are positioned proximate a portion of the sidewalls that define the cabinet side aperture.

6. The hinge assembly of claim 5, wherein the door side aperture defines a sliding path through which the flexible conduit operates to define the serpentine and elongated positions.

7. The hinge assembly of claim 6, wherein the sidewalls include a door side bumper that defines the door side aperture and a cabinet side bumper, wherein the cabinet side bumper defines the cabinet side aperture, the door side bumper defining an outer extent of the sliding path and the elongated position of the flexible conduit, and wherein the door side aperture defines the sliding path through which the flexible conduit can extend directly from the articulating wire chase to the door panel as the flexible conduit operates between the serpentine and the elongated positions.

8. An appliance comprising:

a structural cabinet;

an operable door panel;

a flexible conduit that extends between the structural cabinet and the operable door panel and having a secured portion and a non-secured portion;

an articulating hinge assembly having a cabinet engaging member with a post, an articulating mechanism having a pin and a door engaging member, the articulating hinge assembly operationally engaging the operable door panel to the structural cabinet to define an operational path of the operable door panel that includes an open position corresponding to an extended positon of the articulating hinge assembly and a closed position corresponding to a collapsed position of the articulating hinge assembly; and an articulating wire chase having a base member, an enclosure member and sidewalls that form a housing that is set apart from the structural cabinet and the operable door panel, the housing rotationally attached to the articulating hinge assembly at the post and slidably engaged to the articulating hinge assembly at the pin to cooperatively operate with the articulating hinge assembly between the extended and collapsed positions, the articulating wire chase including a plurality of arcuate retainers that define a securing portion of the articulating wire chase, the plurality of arcuate retainers fixing securing the secured portion of the flexible conduit within the securing portion, wherein:

a cabinet side aperture that is defined in the sidewalls of the housing is positioned proximate an arcuate retainer of the plurality of arcuate retainers;

a door side aperture that is defined by the sidewalls of the housing and that defines a sliding path through which the non-secured portion of the flexible conduit can extend directly from the securing portion of the articulating wire chase to the operable door panel, the sliding path including a repeatable elongated position of the non-secured portion of the flexible conduit when the articulating hinge assembly is in the extended position.

9. The appliance of claim 8, wherein the housing includes a guide slot that slidably engages the pin of the articulating mechanism of the articulating hinge assembly.

10. The appliance of claim 9, wherein the articulating hinge assembly is positioned near a top of the operable door panel.

11. A hinge assembly and a refrigerating appliance, the hinge assembly comprising:

a door engaging member attached to a door panel;

a cabinet engaging member attached to a structural cabinet and having a post;

an articulating mechanism that extends between the door engaging member and the cabinet engaging member, and partially defining an operational path of the door engaging member and the door panel between collapsed and extended positions, the articulating mechanism having a pin;

an articulating wire chase having a housing that includes a base and an enclosure member and sidewalls extending therebetween, the articulating wire chase being rotationally coupled to the cabinet engaging member at the post and slidably coupled to the pin of the articulating mechanism at a guide slot of the housing to define operation of the articulating mechanism between the collapsed position and the extended position that corresponds to operation of the articulating wire chase between a serpentine position and an elongated position, respectively; and flexible conduit extending from the structural cabinet to the door panel, a secured portion of the a flexible conduit being fixedly secured within a securing portion of the housing in each of the serpentine and elongated positions by a plurality of arcuate retainers of the housing, wherein the articulating wire chase is in the elongated position when the articulating mechanism is in the extended position, and wherein a non-secured portion of the flexible conduit extends between the securing portion of the articulating wire chase and the door panel, the non-secured portion of the flexible conduit slidably operating through a sliding path that positions the non-secured portion of the flexible conduit to extend directly from a door side aperture of the articulating wire chase to the door panel.

12. The hinge assembly of claim 11, wherein the securing portion retains the secured portion of the flexible conduit against the base of the housing.

13. The hinge assembly of claim 12, wherein the sidewalls of the housing include a door side bumper and a cabinet side bumper, wherein the door side bumper defines the door side aperture and an outer extent of the elongated position of the non-secured portion of the flexible conduit.

* * * * *